US006591751B2

(12) United States Patent
Sugimoto

(10) Patent No.: US 6,591,751 B2
(45) Date of Patent: Jul. 15, 2003

(54) POWDER APPARATUS FOR SHEET-FED ROTARY PRINTING PRESS

(75) Inventor: Ikuo Sugimoto, Ibaragi (JP)

(73) Assignee: Komori Corporation (JP)

( * ) Notice: Subject to any disclaimer, the term of this patent is extended or adjusted under 35 U.S.C. 154(b) by 0 days.

(21) Appl. No.: 09/798,271

(22) Filed: Mar. 1, 2001

(65) Prior Publication Data

US 2001/0018876 A1 Sep. 6, 2001

(30) Foreign Application Priority Data

Mar. 2, 2000 (JP) ..... 2000-057133

(51) Int. Cl.[7] ..... B41M 1/00; B41C 1/00

(52) U.S. Cl. ..... 101/483; 101/488; 101/416.1; 101/424.1; 399/407

(58) Field of Search ..... 101/416.1, 417, 101/419, 422, 423, 424, 424.1, 424.2, 488, 483; 399/407

(56) References Cited

U.S. PATENT DOCUMENTS 4,807,528 A * 2/1989 Schmoeger et al. ..... 101/424.2
4,867,063 A * 9/1989 Baker et al. ..... 101/424.2
4,882,992 A * 11/1989 Schmoeger ..... 101/424.1
5,001,980 A * 3/1991 Aoki et al. ..... 101/424.2
5,465,153 A * 11/1995 Ladewski ..... 356/376
5,713,285 A * 2/1998 Reed et al. ..... 101/424.2
5,823,112 A * 10/1998 Platsch ..... 101/424.2
5,964,155 A * 10/1999 Platsch ..... 101/424.2

FOREIGN PATENT DOCUMENTS

JP 4-016351 1/1992

* cited by examiner

*Primary Examiner*—Andrew H. Hirshfeld
*Assistant Examiner*—Darius N. Cone
(74) *Attorney, Agent, or Firm*—Blakely Sokoloff Taylor & Zafman

(57) ABSTRACT

A powder apparatus for a sheet-fed rotary printing press includes a nozzle, valve, state detection unit, arithmetic operation unit, and controller. The nozzle sprays powder onto a printed surface of a sheet delivered after printing. The valve adjusts a quantity of powder sprayed from the nozzle. The state detection unit detects a quantity of powder attaching to the sheet. The arithmetic operation unit and controller control the valve on the basis of data output from the state detection unit and indicating a powder quantity.

12 Claims, 5 Drawing Sheets

| | A | B | C | D | E | F | G |
|---|---|---|---|---|---|---|---|
| 1 | 8 | 15 | 25 | 17 | 19 | 4 | 9 |
| 2 | 8 | 15 | 25 | 17 | 19 | 4 | 9 |
| 3 | 8 | 15 | 25 | 17 | 19 | 4 | 9 |
| 4 | 8 | 15 | 25 | 17 | 19 | 4 | 9 |
| 5 | 8 | 15 | 25 | 17 | 19 | 4 | 9 |

| | A | B | C | D | E | F | G |
|---|---|---|---|---|---|---|---|
| 1 | 20 | 20 | 20 | 20 | 20 | 20 | 20 |
| 2 | 20 | 20 | 20 | 20 | 20 | 20 | 20 |
| 3 | 20 | 20 | 20 | 20 | 20 | 20 | 20 |
| 4 | 20 | 20 | 20 | 20 | 20 | 20 | 20 |
| 5 | 20 | 20 | 20 | 20 | 20 | 20 | 20 |

POWDER APPARATUS FOR SHEET-FED ROTARY PRINTING PRESS

BACKGROUND OF THE INVENTION

The present invention relates to a powder apparatus for a sheet-fed rotary printing press which sprays powder onto the printed surfaces of sheets, at a delivery unit in the sheet-fed rotary printing press, before the sheets are sequentially stacked on a pile plate.

At the delivery unit in the sheet-fed rotary printing press, sheets that have just been printed are stacked one by one, so the printed surface of a previously piled sheet and the lower surface of a sheet to be piled next come into contact with each other. The sheets to be piled have just been printed and their ink is not sufficiently dried yet. Thus, ink on the printed surface of the previously piled sheet may be undesirably transferred to the lower surface of the sheet to be piled next, that is, a printing trouble so-called blocking (offset) may occur. In order to prevent this, at the delivery unit of the sheet-fed rotary printing press, powder is sprayed onto the printed surface of the sheet, that has just been printed, from the nozzle of a sprayer. The sprayed powder forms a gap between the sheets, thereby preventing blocking.

In this case, if the powder in a quantity more than necessary is sprayed toward the sheet, the excessive powder may be scattered around to attach to the machine, or even worse cause malfunction of the machine. As excessive powder spraying decreases the value itself of the printed product, the quantity of powder to be sprayed toward the sheet is desirably controlled to the necessary minimum. To set the optimal quantity of powder by reducing the spray quantity, the powder must be sprayed uniformly over the entire sheet, and while considering conditions such as the printing speed, printing density, image area ratio, paper quality, sheet stacking count, and the like.

Japanese Patent Laid-Open No. 4-16351 (reference 1) discloses a powder sprayer which sprays powder only in an optimal quantity. The powder sprayer disclosed in this reference has a powder spray quantity initial setting means for setting an initial powder spray quantity, a powder spray quantity detection means for detecting the powder spray quantity, a powder spray quantity adjusting means for adjusting the powder spray quantity of a powder spray means, and a control means. The control means has an initial preset value converting storage which stores in advance a storage table used for converting printing specification data, input and set by the powder spray quantity initial setting means, into the initial preset value of the powder spray quantity, a comparative determination unit for comparing the obtained initial preset value with the actual measurement value of the powder spray quantity detected by the powder spray quantity detection means, and a powder spray quantity controller for controlling the powder spray quantity adjusting means on the basis of a comparative determination signal sent from the comparative determination unit.

In this arrangement, the actual measurement value of the powder spray quantity detected by the powder spray quantity detection means and the initial preset value are compared. The powder spray quantity is adjusted on the basis of the comparison result.

The powder sprayed toward the sheet surface does not entirely attach to the sheet. More specifically, about ⅓ of the powder spray quantity attaches to the sheet, while the remaining ⅔ is scattered around. The ratio of powder attaching to the sheet changes depending on the temperature and humidity and is not always constant. In other words, the quantity powder sprayed from the powder spray means and the quantity of powder actually attaching to the sheet differ. This difference is not constant but changes from time to time. Therefore, with the conventional powder sprayer for controlling the powder spray quantity on the basis of the quantity of powder actually sprayed from the powder spray means, an optimum quantity of powder cannot be attached to the sheet.

Regarding the powder attaching state, the powder attaches to the entire sheet surface not always uniformly but with a certain degree of nonuniformity. When the powder attaching state varies in this manner, in order to prevent blocking, control operation must be performed with reference to a portion with a small attaching quantity as the criterion. Then, the total powder spray quantity increases more than necessary. In particular, when a plurality of nozzles constituting the powder spray means are provided in the widthwise direction of the sheet, the spray quantities of the plurality of nozzles also vary, further increasing the powder spray quantity.

SUMMARY OF THE INVENTION

It is an object of the present invention to provide a powder apparatus for a sheet-fed rotary printing press, which sets the spray quantity of powder for blocking prevention to an optimal value.

It is another object of the present invention to provide a powder apparatus for a sheet-fed rotary printing press, which eliminates variation in the spray quantity of powder for blocking prevention and can spray the powder uniformly over an entire sheet.

In order to achieve the above objects, according to the present invention, there is provided a powder apparatus for a sheet-fed rotary printing press, comprising spraying means for spraying powder onto a printed surface of a sheet-like object delivered after printing, adjusting means for adjusting a quantity of powder sprayed from the spraying means, detection means for detecting a quantity of powder attaching to the sheet-like object, and control means for controlling the adjusting means on the basis of data output from the detection means and indicating a powder quantity.

DESCRIPTION OF THE PREFERRED EMBODIMENTS

The present invention will be described in detail with reference to the accompanying drawings.

Figure 1:
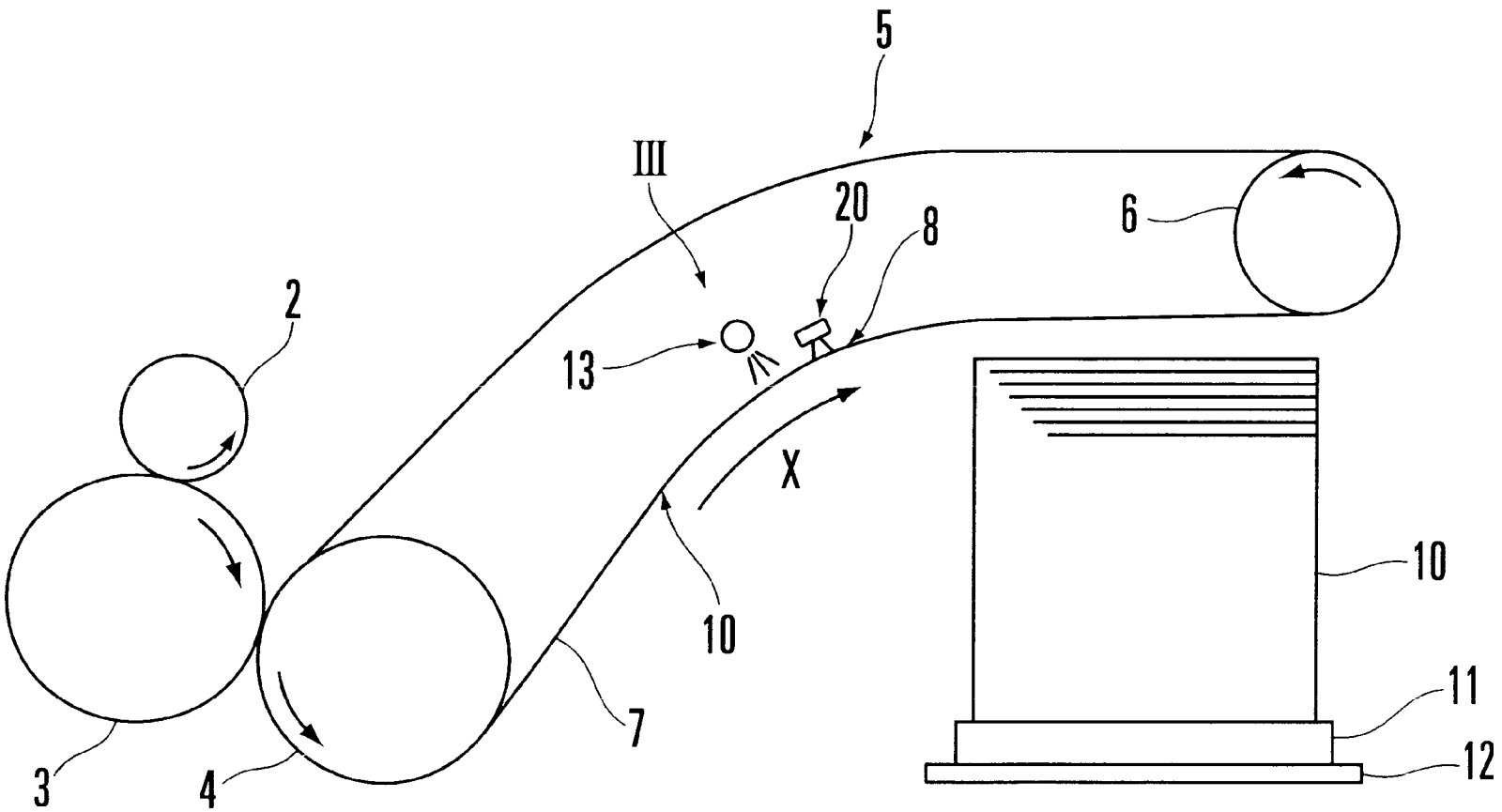
FIG. 1 is a side view showing the schematic arrangement of a powder apparatus for a sheet-fed printing press according to the first embodiment of the present invention.

FIG. 1 shows the schematic arrangement of a powder apparatus for a sheet-fed rotary printing press according to the first embodiment of the present invention. Referring to FIG. 1, a blanket cylinder 2 is in contact with a plate cylinder (not shown), and an impression cylinder 3 is in contact with the blanket cylinder 2. A delivery cylinder (not shown) is in contact with the impression cylinder 3, and a pair of opposing sprockets 4 are axially mounted on a shaft coaxial with the delivery cylinder. A pair of delivery chains 7 extend between the sprockets 4 and sprockets 6 of a delivery unit 5.

A plurality of gripper bars (not shown) are supported between the delivery chains 7 at predetermined pitches, and a plurality of sets of gripper units (to be merely referred to as grippers hereinafter) 8 each comprised of a gripper and gripper pad line up on each gripper bar in an array. A pile board 12 suspended by an elevating chain (not shown) is provided below the terminal ends (downstream in a sheet convey direction X) of the delivery chains 7. A pile plate 11 is mounted on the pile board 12 to stack thereon sheets 10 as sheet-like objects that fall as they are released by the gripper units 8 of the delivery chains 7.

Figure 2:
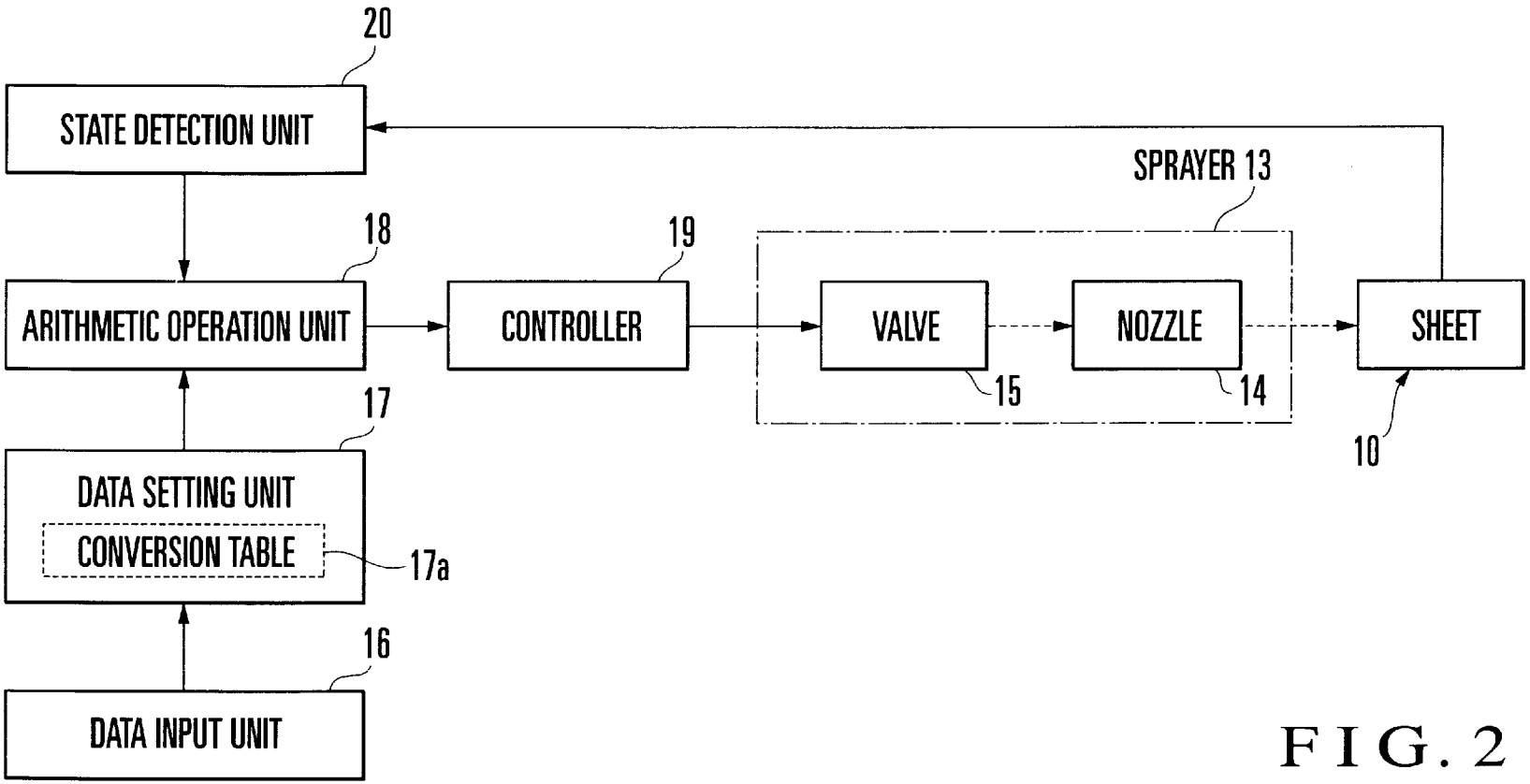
FIG. 2 is a block diagram of the powder apparatus shown in FIG. 1.

A sprayer 13 is provided upstream of the pile plate 11 in the sheet convey direction X. As shown in FIG. 2, the sprayer 13 has a nozzle 14 for spraying (injecting) the powder and a valve 15 which is opened or closed to adjust the spray quantity of powder from the nozzle 14. In the sprayer 13, powder, the quantity of which has been adjusted by the valve 15, is sprayed from the nozzle 14 with air supplied from an air source (not shown). Regarding the sprayer 13, the disclosed content of the reference 1 is incorporated in the present application. Close to the sprayer 13, a state detection unit 20 is arranged downstream in the sheet convey direction X.

Figure 4A:
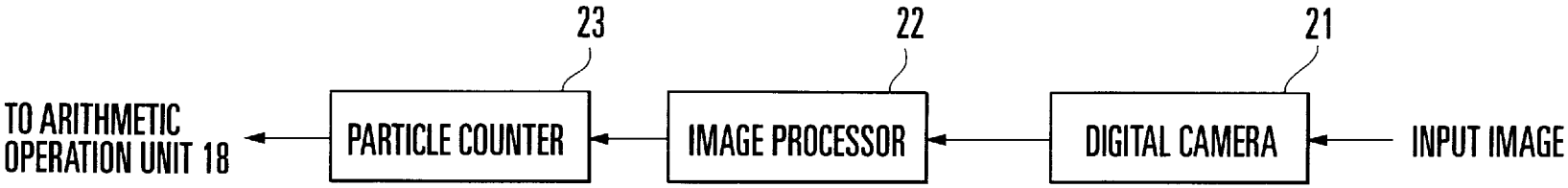
FIG. 4A is a block diagram of the state detection unit shown in FIG. 2.
Figure 4B:
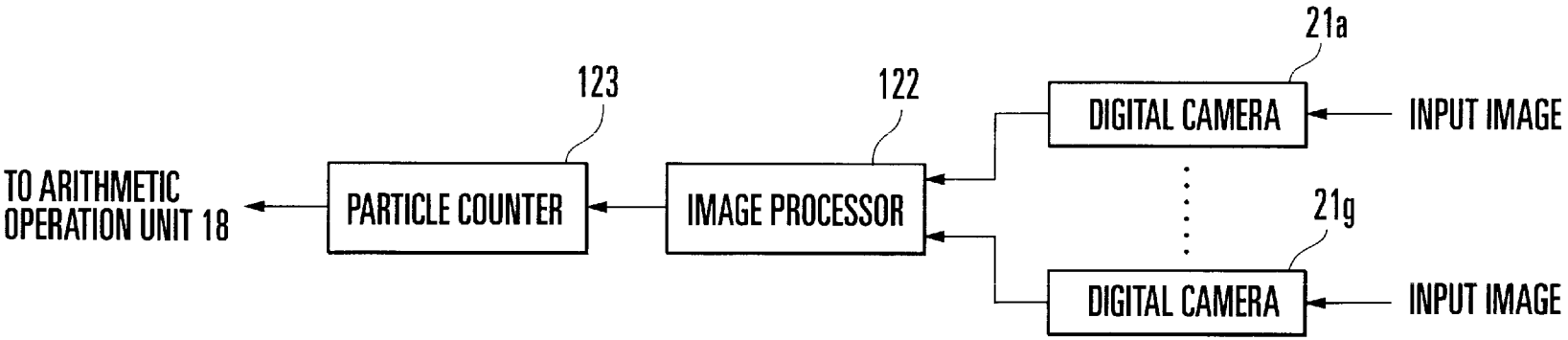
FIG. 4B is a block diagram showing another example of the state detection unit.

As shown in FIG. 4A, the state detection unit 20 is comprised of a digital camera 21 for radiating the printed surface of the sheet 10, under conveyance by the delivery chains 7, with ultraviolet rays from an ultraviolet radiating unit (not shown) and optically recording powder particles attaching to the printed surface as a digital image, an image processor 22 for image-processing the recorded digital image, and a particle counter 23 for counting the number of powder particles on the processed image. With this arrangement, the state detection unit 20 numerically evaluates the quantity of powder attaching to the printed surface as numerical data.

The sprayer 13 descried above further has a data input unit 16 to which printing specification data such as the paper quality, sheet size, image area ratio, printing density, printing speed, sheet stacking count, and the like are input in advance, a data setting unit 17 with a conversion table 17*a* for converting the printing specification data into a spray quantity preset value, an arithmetic operation unit 18 for comparing an output from the state detection unit 20 with an output from the data setting unit 17, and a controller 19 for controlling the opening/closing amount of the valve 15 of the sprayer 13 in accordance with an output from the arithmetic operation unit 18.

The data setting unit 17 converts the printing specification data input to the data input unit 16 into a preset value indicating the optimal quantity of powder to be attached to the sheet 10 by looking up the conversion table 17*a*, and holds the obtained preset value. The conversion table 17*a* is formed on the basis of data obtained by repeating experiments while changing the paper quality, sheet size, image area ratio, printing density, printing speed, sheet stacking count, ink type, and the like in various manners. The preset value can be changed when needed in accordance with the operator's decision based on his or her experience.

The arithmetic operation unit 18 compares the respective numerical data output from the state detection unit 20 and indicating the powder attaching states with the preset value output from the data setting unit 17, and outputs the comparison result to the controller 19. The controller 19 controls the opening/closing amount of the valve 15 of the sprayer 13 in accordance with the comparison result of the arithmetic operation unit 18.

The adjusting operation of the powder spray quantity in the powder apparatus with the above arrangement will be described.

First, printing specification data such as the paper quality, sheet size, image area ratio, printing density, printing speed, sheet stacking count, ink type, and the like are input to the data input unit 16. When the printing specification data are input to the data input unit 16, the data setting unit 17 converts it into a preset value indicating the optimal quantity in the initial state of the powder to be attached to the sheet 10 by looking up the conversion table 17*a*. The preset value in the initial state differs depending on the total count of the sheets 10 to be stacked on the pile plate 11. The preset value decreases stepwise as more sheets 10 are stacked on the pile plate 11. This is because the lower a stacked sheet is, the more likely it causes blocking due to the weight of the sheets stacked on it. The higher the sheet is, the smaller the powder spray quantity can be.

As printing is started, when the sheet 10 gripped by the grippers (not shown) of the impression cylinder 3 passes through the contact portion between the impression cylinder 3 and blanket cylinder 2, the ink attaching to the blanket cylinder 2 is transferred to the printed surface of the sheet 10, thereby performing printing. Then, at the contact portion between the impression cylinder 3 and a delivery cylinder (not shown), the sheet 10 is transferred from the grippers of the impression cylinder 3 to the grippers 8 of the delivery chains 7. Before the sheet 10 under conveyance by the traveling delivery chains 7 in the direction of an arrow X falls to be stacked on the pile plate 11, the powder is sprayed from the nozzle 14 of the sprayer 13 toward the printed surface of the sheet 10.

The initial attaching state of the powder on the printed surface of the sheet 10 is optically detected by the state detection unit 20, and the powder attaching quantity is numerically evaluated from numerical data. The arithmetic operation unit 18 compares the numerical data output from the state detection unit 20 and the preset value output from the data setting unit 17, and outputs a comparison result to the controller 19.

If the numerical data is smaller than the preset value, the controller 19 performs control to open the valve 15 of the nozzle 14. If the numerical data is larger than the preset value, the controller 19 performs control to decrease the opening amount of the valve 15 of the nozzle 14. As the opening amount of the valve 15 changes, the quality of powder sprayed from the nozzle 14 changes, and the spray quantity for the sheet 10 also changes. Thus, the evaluation data of the powder to be sprayed onto the sheet 10 to be conveyed next is controlled to coincide with the preset value.

According to the first embodiment, since the quantity of powder to be sprayed is adjusted in accordance with the quantity of powder actually attaching to the sheet 10, the quantity of powder attaching to the sheet 10 becomes optimal. As a result, the use quantity of powder is reduced to the necessary minimum. It was confirmed through experiments that the present invention could reduce the use quantity of powder by 50% at maximum that of the conventional case wherein the powder spray quantity was not controlled on the basis of the actual powder attaching quantity.

The second embodiment of the present invention will be described with reference to FIG. 3. The difference between the first and second embodiments resides in that, in the second embodiment, the sprayer is comprised of a plurality of sets of valves and nozzles, and has a plurality of state detection units to correspond to the plurality of sets of valves and nozzles. Except for this, the arrangement of the second embodiment is the same as that of the first embodiment, and a detailed description thereof will accordingly be omitted.

Figure 3:
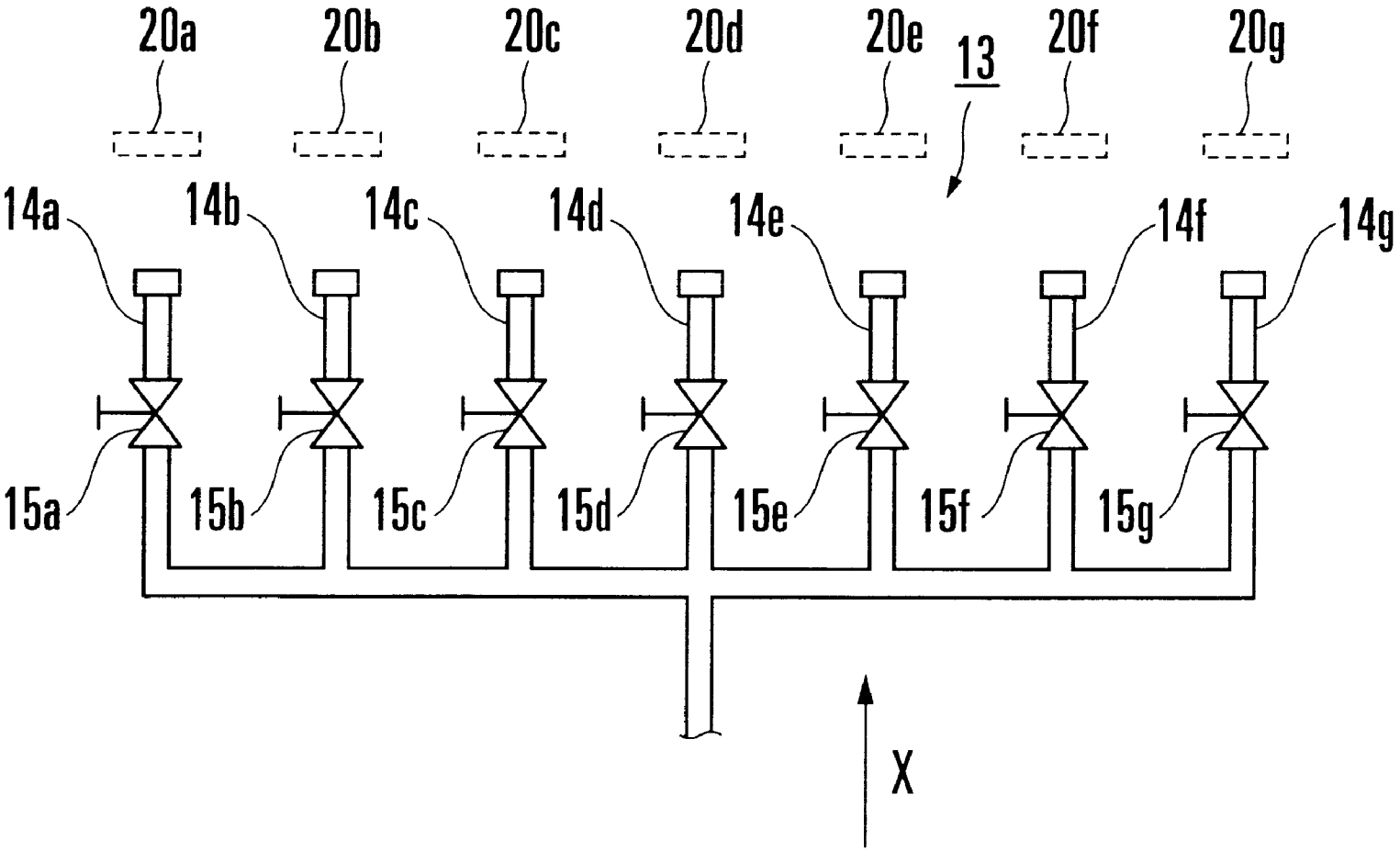
FIG. 3 is a view seen from the direction of arrow III of FIG. 1 to show a powder apparatus according to the second embodiment of the present invention.

As shown in FIG. 3, a sprayer 13 is comprised of 7 nozzles 14*a* to 14*g* placed equidistantly in the widthwise direction of a sheet 10, i.e., in a direction perpendicular to a sheet convey direction X, and 7 valves 15*a* to 15*g* for controlling the quantities of powder to be sprayed from the nozzles 14*a* to 14*g*. Seven state detecting units 20*a* to 20*g* are placed, to correspond to the nozzles 14*a* to 14*g*, downstream in the sheet convey direction X equidistantly in the widthwise direction of the sheet 10, i.e., in the direction perpendicular to the sheet convey direction X. Each of the state detecting units 20*a* to 20*g* has the same arrangement as that of the state detection unit 20 shown in FIG. 4A.

Figures 5A, 5B, 5C:
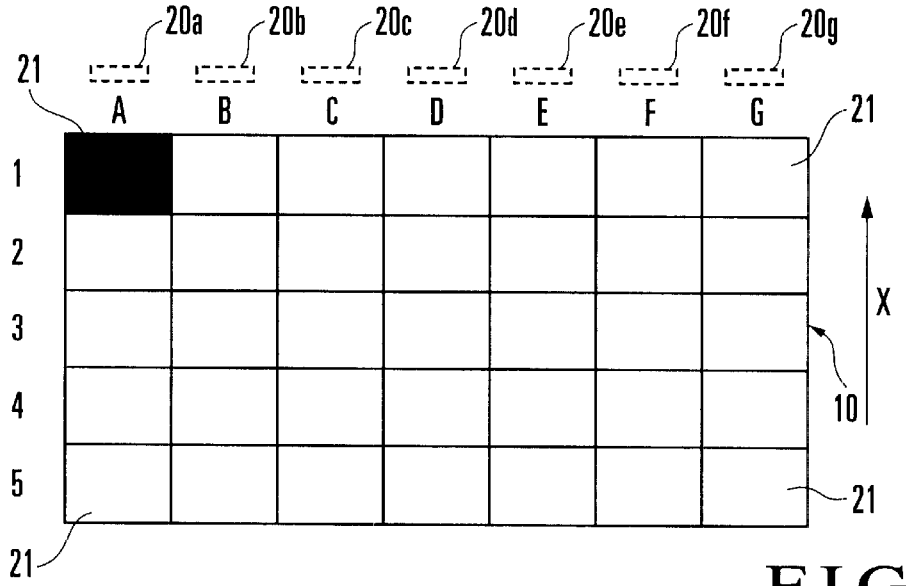
FIG. 5A is a table showing a state wherein the printed surface of a sheet is defined into a large number of evaluation cells arranged in a matrix.
FIG. 5B is a table showing the quantities of powder actually attaching within the respective evaluation cells as numerical data.
FIG. 5C is a table showing the optimal attaching quantities of the powder within the respective evaluation cells as preset values.

As shown in FIG. 5A, the printed surface of the sheet 10 is divided into 7 regions (band-like regions) A to G in the direction perpendicular to the sheet convey direction X to have the same widths. The printed surface of the sheet 10 is also divided into 5 regions 1 to 5 in the sheet convey direction X to have the same widths. Thus, the printed surface of the sheet 10 is defined into 35 matrix sections (cell regions) 21 with the same areas. Of these sections 21, the attaching quantities of powder sprayed from the nozzles 14*a* to 14*g* are numerically evaluated as numerical data in units of sections 21. Therefore, the sections 21 will be referred to as the evaluation cells 21 hereinafter.

The state detecting units 20*a* to 20*g* are arranged to correspond to the regions A to G of the sheet 10, i.e., to correspond to the evaluation cells 21 lining up in the direction perpendicular to the sheet convey direction X. With this arrangement, when the sheet 10 is conveyed in the direction of the arrow X, the evaluation cells 21 lining up in the direction perpendicular to the direction X of the arrow sequentially pass below the state detecting units 20*a* to 20*g* in units of rows. The state detecting units 20*a* to 20*g* detect the powder quantities attaching within the evaluation cells 21 in units of rows to cover five rows. Therefore, the powder attaching quantities of the 35 evaluation cells 21 are separately numerically evaluated.

The adjusting operation of the powder spray quantity of the powder apparatus with the above arrangement will be described.

Printing specification data such as the paper quality, sheet size, image area ratio, printing density, printing speed, sheet stacking count, ink type, and the like are input to a data input unit (not shown). Upon input of the printing specification data, the preset values of the respective evaluation cells 21 are set to, e.g., "20", as shown in FIG. 5C, as the optimal powder attaching quantities. After that, when the printing operation is started, before the sheet 10 under conveyance by traveling delivery chains 7 in the direction X of arrow falls to be stacked on the pile plate 11, powder is sprayed from the nozzles 14*a* to 14*g* of the sprayer 13 onto the printed surface of the sheet 10.

The state detecting units 20*a* to 20*g* are arranged to correspond to the regions A to G of the sheet 10. As the sheet 10 is conveyed, the initial powder attaching state on the printed surface of the sheet 10 is detected in all of the evaluation cells 21. The powder attaching state is detected by the state detecting units 20*a* to 20*g* in accordance with various methods, i.e., a method of detecting the powder attaching state in all the evaluation cells 21, and a method of detecting the powder attaching state by sampling some of the evaluation cells 21.

The powder attaching states in the respective evaluation cells 21, which are detected by the state detecting units 20*a* to 20*g*, are numerically evaluated in the respective evaluation cells such that the region A is "8", the region B is "15", the region C is "25", the region D is "17", the region E is "19", the region F is "4", and the region G is "9". These numerical data and preset value "20" shown in FIG. 5B are compared by the arithmetic operation unit 18 in units of the evaluation cells 21. The comparison results are sent to the controller 19.

If the numerical data of the evaluation cell 21 is smaller than the preset value "20", the controller 19 performs control to open the corresponding one of the valves 15*a* to 15*g* of the nozzles 14*a* to 14*g*. If the numerical data is larger than the preset value "20", the controller 19 performs control to decrease the opening amount of the corresponding one of the valves 15*a* to 15*g* of the nozzles 14*a* to 14*g*. Thus, for the sheet 10 that has been conveyed next, the powder spray quantity from the sprayer 13 is controlled to coincide with the preset value "20" in units of evaluation cells 21 of the sheet 10. This powder spray quantity control operation is repeated every time a sheet 10 is conveyed, and the powder spray quantity is always controlled to the constant preset value "20".

According to the second embodiment, since the powder attaching quantities within the respective evaluation cells 21 are adjusted separately to the optimal value, the powder does not vary in the spray quantity but is uniformly sprayed over the entire sheet 10. Since the spray quantities from other nozzles need not be increased to match a portion where the powder attaching quantity is small, the powder spray quantity does not increase more than necessary.

According to the above embodiments, the powder particles are counted by the state detection unit 20 with the digital camera 21. However, the present invention is not limited to this. For example, the density of the powder itself sprayed to the sheet may be detected, or a change in ink density that occurs as the powder is sprayed to the printed sheet may be detected. Alternatively, the printed state may be detected from the area ratio of the ink portion to the powder attaching portion of the printed sheet. Various design changes may be made as far as the printed state is detected.

In the above embodiments, for the sake of descriptive convenience, the state detection unit 20 constituting a single unit is placed in the vicinity of the sprayer 13. Alternatively, a digital camera 21 may be arranged in the vicinity of a sprayer 13, and an image processor 22 and particle counter 23 may be housed in a control unit, as a matter of course. In this case, in the second embodiment, an image processor 122 and particle counter 123 may be provided to be shared by digital cameras 21*a* to 21*g*, and a plurality of input images may be serially processed at a high speed. The image processor 122 and particle counter 123 can be realized by executing a program by using a CPU (Central Processing Unit).

The valve 15 of the nozzle 14 serves as the adjusting means for adjusting the powder spray quantity. Alternatively, a powder blowing speed may be controlled. Although the printed surface is defined into the 35 evaluation cells 21, the number of evaluation cells 21 is not limited to this. As shown in FIG. 5B, when the powder quantity does not change in the cells of the band-like regions A to G, the powder quantity may be controlled not in units of cell regions but in units of band-like regions A to G.

As has been described above, according to the present invention, the quantity of powder to be sprayed onto a sheet-like object is adjusted on the basis of the quantity of powder actually attaching to the sheet. Thus, the quantity of powder to be sprayed onto the sheet surface becomes optimal, and the use quantity of powder is reduced. As a result, not only the printing value can be prevented from being decreased by excessive powder spraying, but also a machine trouble caused when, e.g., the scattered powder gets mixed in the lubricating oil of the printing machine, can be prevented. Also, the number of times of cleaning can be reduced, and the material cost of the powder can be reduced.

Since the machine is automatically controlled such that the powder quantity coincides with the preset value, constant control operation can always be performed without requiring the skill of the operator. Since constant monitoring of the operator becomes unnecessary, the work load of the operator is reduced.

Since the powder attaching quantities within the respective evaluation cells 21 are adjusted separately to the optimal value, the powder does not vary in the spray quantity but is uniformly sprayed over the entire sheet. Since the spray quantities from other nozzles need not be increased to match a portion where the powder attaching quantity is small, the powder spray quantity does not increase more than necessary.

What is claimed is:

1. A powder apparatus for a sheet-fed rotary printing press, comprising:

spraying means for spraying powder onto a printed surface of a sheet object delivered after printing;

adjusting means for adjusting a quantity of powder sprayed from said spraying means;

detection means for detecting a quantity of powder attaching to the sheet object; and control means for controlling said adjusting means on the basis of data output from said detection means and indicating a powder quantity.

2. An apparatus according to claim 1, wherein said apparatus further comprises data input means for inputting printing specification data, and data setting means for setting a powder spray quantity to the optimal value on the basis of the printing specification data input to said data input means, and said control means controls said adjusting means on the basis of the data output from said detection means and indicating the powder quantity and optimal value data output from said data setting means.

3. An apparatus according to claim 2, wherein said control means has comparing means for comparing the data output from said detection means and indicating the powder quantity and the optimal value data output from said data setting means, controls said adjusting means, when a comparison result of said comparing means shows that the data output from said detection means and indicating the powder quantity is larger than the optimal value data output from said data setting means, such that the powder quantity to be sprayed decreases, and controls said adjusting means, when the comparison result of said comparing means shows that the data output from said detection means and indicating the powder quantity is smaller than the optimal value data output from said data setting means, such that the powder quantity to be sprayed increases.

4. An apparatus according to claim 2, wherein said setting means has a conversion table for converting the printing specification data input to said input means into the optimal value of the powder spray quantity.

5. An apparatus according to claim 2, wherein the printing specification data input to said input means includes at least one of paper quality, sheet size, image area ratio, printing density, printing speed, sheet stacking count, and ink type.

6. An apparatus according to claim 2, wherein the optimal value set in said data setting means decreases as a stacking amount of sheet objects stacked on a pile plate increases.

7. An apparatus according to claim 1, wherein said spraying means is comprised of a plurality of nozzles placed equidistantly in a direction perpendicular to a sheet convey direction, said adjusting means is comprised of a plurality of adjusting valves provided to correspond to said nozzles, and said detection means is comprised of a plurality of state detection units placed in the vicinity of said nozzles and downstream in the sheet convey direction.

8. An apparatus according to claim 7, wherein the sheet object has a printed surface which is divided into a plurality of band regions at least in the direction perpendicular to the sheet convey direction, and said control means performs control to separately open/close said adjusting valves on the basis of data output from said detection units and indicating powder quantities in units of band regions and optimal value data output from said data setting means.

9. An apparatus according to claim 7, wherein the sheet object has a printed surface which is comprised of a plurality of cell regions divided into a matrix in the sheet convey direction and the direction perpendicular to the sheet convey direction, and said control means repeats, in units of cell region lines, control operation of performing control to separately open/close said adjusting valves on the basis of data output from said detection units and indicating powder quantities in units of cell regions in the direction perpendicular to the sheet convey direction and optimal value data output from said data setting means.

10. An apparatus according to claim 1, wherein said detection means comprises a camera for optically recording powder particles attaching to the printed surface in the form of a digital image, an image processor for image-processing the digital image recorded by said camera, and a particle counter for counting the number of powder particles on an image processed by said image processor.

11. An apparatus according to claim 10, wherein only said digital camera is placed, in the vicinity of said nozzle, downstream in the sheet convey direction.

12. An apparatus according to claim 1, wherein said detection means detects the quantity of powder attaching to the sheet object in accordance with a printed state of the sheet object.

* * * * *